US005305999A

United States Patent [19]

Tate

[11] Patent Number: 5,305,999

[45] Date of Patent: Apr. 26, 1994

[54] GOLF ACCESSORY

[76] Inventor: John Tate, 14535 Firestone Blvd., La Mirada, Calif. 90638

[21] Appl. No.: 821,033

[22] Filed: Jan. 16, 1992

[51] Int. Cl.[5] ..... A63B 57/00

[52] U.S. Cl. ..... 273/32 B; 224/252; 224/269

[58] Field of Search ..... 273/32 A, 32 B, 32; 224/269, 252; 24/3 R

[56] References Cited

U.S. PATENT DOCUMENTS

| | | | |
|---|---|---|---|
| 125,921 | 4/1872 | Will et al. | 224/252 |
| 3,744,542 | 7/1973 | Stephens et al. | 273/32 A |
| 4,237,583 | 12/1980 | Sullivan | 24/3 R |
| 4,315,624 | 2/1982 | Buckman | 273/32 B |
| 4,358,036 | 11/1982 | Maltais | 224/252 |
| 4,627,621 | 12/1986 | Tate | 273/32 B |
| 4,960,239 | 10/1990 | Wait | 273/32 A |
| 5,116,046 | 5/1992 | Pace | 273/32 B |

*Primary Examiner*—Theatrice Brown
*Attorney, Agent, or Firm*—Charles H. Thomas

[57] ABSTRACT

A golf accessory has a flat, planar, disc shaped metal shield from the edge of which a pair of legs extend in generally parallel fashion. Opposite the legs there is a projection in the top of which a transverse groove is defined. The groove is of a size suitable for cradling a cigarette inserted therein. The projection may be formed as a return bent back in a loop to extend rearwardly from the metal shield to terminate in a backing plate located behind the shield. The leaf spring is secured to the surface of the backing plate facing the shield and can be resiliently deflected to receive varying thicknesses of bills or other papers. The backing plate and the shield may each also be provided with recessed regions in which magnets may be mounted to receive disc shaped ball markers thereatop. The ball markers are firmly held by magnetic attraction in the recessed regions atop the magnets, but can be readily removed therefrom. Rather than being formed as a lopped return, the projection may reside solely in the plane of the shield and form a pair of straight ears on either side of the groove. The ears are narrow enough to fit into the grooves in the face of a golf club so that the tool can be used to clean those grooves.

4 Claims, 2 Drawing Sheets

GOLF ACCESSORY

BACKGROUND OF THE INVENTION

1. Field of the Invention

The present invention relates to an improved golf accessory which can be utilized as a divot tool and also as a cigarette holder on a golf course.

2. Description of the Prior Art

Prior golf accessory tools have been utilized to advantage for a number of years. One particularly useful golf accessory tool is described in my prior U.S. Pat. No. 4,627,621. This patent describes a golf accessory which serves both as a divot tool and as a money clip. The clip can be used as a means of attachment of the accessory to the belt, cap, shoe or golf bag of a golfer. It can also serve as a money clip. The accessory described in my prior patent includes a looped return behind a disc shaped body which defines a saddle facing concave upwardly. The saddle serves as a stand or prop for supporting the grip of a golf club above the grass, so as to prevent the grip from becoming wet with dew or other moisture which may be on the turf.

While my prior golf accessory disclosed in the aforesaid patent is a highly useful tool, I have discovered a number of improvements which can be made to such a golf accessory to increase its versatility and to enhance its usefulness.

SUMMARY OF THE INVENTION

One important object of my new golf accessory disclosed herein is enhanced versatility which is achieved by constructing the accessory so that it can hold a cigarette. Like the golf accessory of my prior U.S. Pat. No. 4,627,621, the improved golf accessory of the present invention is formed with a flat planar body having an obverse surface and a reverse surface and a peripheral edge therebetween. A pair of elongated generally parallel legs extend from the peripheral edge of the body.

According to the present invention the golf accessory also includes a projection from the peripheral edge at a location on the body opposite the legs. A transverse groove is defined within this projection. This groove is oriented perpendicular to the plane of the body and is of a size which is particularly adapted to hold a cigarette therein. That is, the transverse groove is preferably of an arcuate configuration and is about six millimeters in width. A significant number of golfers enjoy smoking during the course of a round of golf. Such a golfer encounters inconveniences, however, when a shot must be made at a time when the golfer happens to be holding a lighted cigarette. While ashtrays are often provided in the vicinity of golfing tees so as to provide a golfer with a place to rest a cigarette while the golfer tees off, ash trays are unavailable on the fairway and on the green. Consequently, while the golfer is employing both hands to grip a golf club so as to make an approach shot or to putt, there has been no provision for dealing with a lighted cigarette which the golfer may be carrying at the time.

Until now the golfer might elect to discard the cigarette and stamp it out on the ground. This is particularly annoying to the golfer if the cigarette has only recently been lit. Furthermore, the relatively lengthy discarded cigarette butt must be removed by the golfer or by some other person so as not to constitute unsightly debris. Alternatively, the golfer may elect to retain the lighted cigarette and hold it between his or her lips while employing both hands to make an approach shot or a putt. However, the smoke emanating from the burning cigarette in the golfer's mouth can disrupt both the vision and concentration of the golfer and affect the accuracy of the shot.

The golf accessory of the invention not only serves as a divot tool and money clip, like that of my prior U.S. Pat. No. 4,627,621, but also serves as a cigarette holder which can be used to support a lighted cigarette a short distance above the surface of the golf course. Therefore, the cigarette is not in close proximity to the golfer's face while the golfer is making a shot. To this end the projection at the top of the golf accessory on the side of the body thereof remote from the legs is provided with a transverse groove or slot that is oriented perpendicular to the plane of the body of the tool.

When a golfer wishes to make either an approach shot or a putt, but still retain a lighted cigarette, the body of the cigarette can be inserted into the slot of the golf accessory of the invention so that the cigarette is aligned generally along the axis of the slot and perpendicular to the plane of the body of the device. The legs of the tool, which are located opposite the projection in which the slot is formed, are inserted into the ground. The cigarette is thus elevated several inches above the surface of the course. When the golf accessory is used in this matter the smoke from the lighted cigarette will not be anywhere near the face of the golfer as the golfer prepares for and executes a shot. Once the shot has been completed, the golfer can merely pluck the cigarette from the slot, remove the tool from the turf, and proceed toward the area where the ball has landed from the shot just executed. The golfer is not forced to discard the cigarette in order to complete a golf shot, and the golfer's face is nowhere near the smoke from the cigarette during preparation and execution of the shot.

In one preferred embodiment of the present invention the projection on the top of the body of the golf accessory is formed as a hooked return which extends from the peripheral edge opposite the legs and is bent to form a loop. This loop terminates in a backing plate. Like the golf accessory of my prior U.S. Pat. No. 4,627,621, the looped return that extends rearwardly from the body of the accessory terminates in a backing. Unlike the backing of my prior patent, however, the backing of the golf accessory of the present invention is configured as a planar plate which is oriented generally parallel to and located at a spaced, transverse distance from the planar body of the tool. Also, unlike my prior tool, a highly resilient leaf spring is provided to form a part of the tool. The backing and the body are spaced a short distance apart from each other and the leaf spring is located between these spaced members. The leaf spring may be attached to either the backing or the body of the golf accessory. The leaf spring includes a central, arcuately curved portion which projects toward the other of the spaced members to which the leaf spring is not attached.

In one form of the invention the body or shield of the tool and the backing plate both have obverse and reverse surfaces. The reverse surfaces of the shield and backing plate face each other and form a pair of spaced confining surfaces. The leaf spring has a free end and an anchored end, with an arcuately configured intermediate portion therebetween. If the anchored end of the leaf spring is secured to the backing plate, the intermediate, arcuate portion of the leaf spring projects toward the reverse surface of the shield or body of the tool. Since one end of the leaf spring is free, the intermediate, arcuate portion of the leaf spring can be readily depressed and deflected in a resilient fashion. Thus, a user is able to insert papers, such as currency notes between the leaf spring and the reverse surface of the body of the golf accessory. The golf accessory can thereby be employed as a money clip which accommodates folded or unfolded currency notes having a wide range of thicknesses.

While the golf accessory of my prior U.S. Patent does adequately accommodate a plurality of folded bills in a stack having a relatively narrow range of thicknesses, the golf accessory of the present invention can easily accommodate a stack of bills having a far greater thickness, as well as a considerably thinner stack of bills. The range of thicknesses accommodated by the device of the present invention is far greater than with the device of my prior patent. This is because the leaf spring is formed of spring steel having a far greater resiliency than either the shield or the backing plate forming the tool of my invention. The leaf spring can be resiliently compressed to a considerable degree. Consequently, stacks of currency notes of considerably varying thickness can be inserted between the reverse surfaces of the backing plate and the shield of the golf accessory of the present invention and clamped firmly by the leaf spring.

Because the leaf spring is so resilient, other articles which vary greatly in thickness can also be inserted and held between the backing plate and the shield of the golf accessory of the invention. Golf score cards, business cards, facial tissues, and other paper and non-paper articles having considerable variations in thickness can be selectively held in the golf accessory of the invention.

Preferably, the anchored end of the leaf spring has a polygonal shaped fastening aperture thereon which may, for example, be an opening of square configuration. This aperture is adapted to receive a fastener having a corresponding polygonal cross section that is attached to either the body or the backing plate. A fastener of polygonal cross section is inserted into the polygonal opening in the anchored end of the leaf spring and secured to either the reverse surface of the backing plate or the reverse surface of the shield. The leaf spring is thereby prevented form rotating relative to the member to which it is attached. Thus, the leaf spring will remain in uniform alignment relative to the backing plate and the shield, preferably generally parallel to the legs of the golf accessory.

The golf accessory of the invention may also perform the additional function of carrying a ball marker. Golf ball markers are frequently employed in golfing, particularly on a golf course green, so as to prevent a rolling golf ball from striking another golf ball which is at rest on the green. That is, when a golfer's ball is in a position where it may be struck by the shot of another golfer, one merely removes the golf ball from the field of play and marks its position with a flat ball marker. Even if the shot of another golfer should pass along a course which directly intersects the position of another ball at rest, neither ball will be disrupted. By removing a ball which has come to rest from the course and replacing it with a ball marker, the moving ball will not be deflected in its course of travel, nor will the ball at rest be knocked out of position.

The backing plate of the golf accessory of the invention has both a reverse surface facing the reverse surface of the shield, and an obverse surface directed away from the shield. A backing recess, which is normally a disc shaped recess, may be defined in the obverse surface of the backing plate. This backing recess may be, for example, about 1.8 centimeters in diameter and about 0.2 centimeters in depth. Preferably also, a backing magnet is secured to the backing plate in the backing recess defined in the obverse face thereof. A first ball marker, made of a material attracted by magnetism, can be removably located atop the magnet in the backing recess. The magnetic force of attraction of the backing magnet thereby holds the first golf ball marker atop the backing magnet in the backing recess, thereby providing a convenient storage space for the first ball marker.

Different golfers sometimes prefer ball markers of different sizes. Accordingly, the shield or body of the golf accessory of the invention may also or alternatively have a shield recess defined within its obverse surface. The shield recess typically occupies an area greater than the area of the backing recess. For example, the shield recess may have a diameter of about 2.6 centimeters and a depth of about 0.2 centimeters.

A shield magnet may be located in the shield recess to cover less than the entire peripheral area of the shield recess. A second ball marker having an area larger than that of the first ball marker may also be provided. Both ball markers are formed of a material attracted by magnetic force. The second ball marker has a larger diameter than that of the first and is removably positionable atop the shield magnet in the shield recess. In this way the shield magnet holds the second ball marker in the shield recess by magnetic force in a manner similar to the way which the backing magnet holds the first ball marker.

Both ball markers may preferably be formed as thin, disc shaped wafers of steel or iron. The ball markers are normally left uncoated on their undersides so that the magnetically attractable surfaces thereof may be disposed directly against the magnets in the recesses. The exposed surfaces of the ball markers are normally decorated in an aesthetically pleasing manner, either with some design or possibly with the logo or crest of a country club or golfing association.

Each magnet preferably takes the form of a thin, magnetic slab that occupies less than the entire peripheral area of the recessed region in which it is disposed in either the backing plate or the shield. For example, the magnetic slab may be formed of rubber impregnated with magnetized iron chips and shaped in the form of a circle with a segment removed therefrom. Each disc shaped ball marker extends not only over the top of the magnet, but also over the segment of the circular recess which is not occupied by the magnetic slab. This leaves an unfilled cavity at the periphery of the recessed area beneath a portion of the ball marker.

With a golf accessory of the structure described, the ball markers will be firmly held in position in the recesses by the magnetic force of attraction of the magnets. Nevertheless, each marker can be readily removed by external force exerted against an edge of the ball marker inwardly toward the cavity therebeneath. This causes the ball marker to act as a lever with the fulcrum quite close to the edge of the ball marker at which inward force is applied. By exerting force against the ball marker and by forcing the edge of the ball marker into the cavity, the much larger, remaining portion of the ball marker is rotated outwardly away from the magnet in the recess, and largely out of the magnetic field of attraction thereof. The ball marker can then be readily seized at an exposed edge by the golfer's thumb and forefinger and deployed for use.

The projection from the peripheral edge of the golf accessory in which the slot or groove is formed to receive a cigarette does not necessarily have to be constructed as a return. Indeed, the projection can lie entirely within the plane of the body or shield. In such an embodiment the projection is bifurcated by the transverse slot to form a pair of ears, the tips of which are narrow enough to fit into the grooves on the face of a golf club. These grooves in a golf club face are provided to impart an appropriate spin to a golf ball during execution of a shot. However, the grooves can sometimes become partially or completely clogged with soil. By providing the projection which is formed with a pair of ears or tabs that are narrow enough to fit into the grooves in the face of a golf club, soil and other debris can be quickly and easily cleaned out of the grooves in the golf club face.

Still another unique feature of the invention resides in the cross sectional configuration of the legs of the golf accessory. In my prior patent the legs each have a rib or peak along the sides thereof that extend from the obverse surface of the shield or body of the golf accessory. The opposite sides of the legs are flat and co-planar with the reverse side of the body.

According to the present invention, however, this construction is changed. The legs of the golf accessory of the present invention have obverse and reverse surfaces and mutually proximate and mutually remote longitudinally extending edges. The proximate and remote edges reside on opposite sides of a longitudinal axis for each leg. Each of the legs has a raised rib on both its obverse and reverse surfaces at the longitudinal axis. In this way each of the legs is laterally tapered in cross section and has a greatest thickness along its longitudinal axis. Each leg tapers laterally toward both the proximate and remote edges on both its obverse and reverse surfaces. A golf accessory having legs constructed in this manner can be more readily inserted into and removed from the turf on a golf course surface while leaving only minimal traces of its insertion following removal.

In one broad aspect the present invention may be considered to be a golf accessory formed with a flat, planar body having an obverse surface and a reverse surface and a peripheral edge therebetween. A pair of elongated generally parallel legs extend from the peripheral edge. A projection extends from the peripheral edge at a location on the body opposite the legs. According to the improvement of the invention the projection defines therewithin a transverse groove oriented perpendicular to the plane of the body. This groove is adapted to hold a cigarette therein.

In another broad aspect the invention may be considered to be an improvement in a golf accessory formed with a flat, planar metal shield having a peripheral edge thereabout and a pair of thin legs extending generally parallel to each other from the edge of the metal shield. The improvement of the invention comprises a projection from the metal shield at a location on the peripheral edge opposite the legs. The projection defines therewithin a transverse slot that is oriented perpendicular to the plane of the shield. This slot is adapted to receive and grip a cigarette therewithin.

The invention may be described with greater clarity and particularity by reference to the accompanying drawings.

DESCRIPTION OF THE EMBODIMENTS

Figure 1:
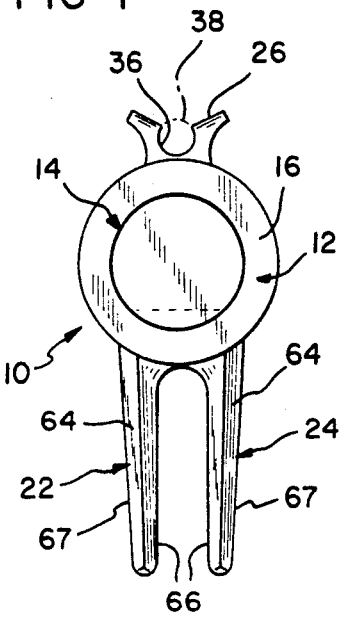
FIG. 1 is a front elevational view of one preferred embodiment of the golf accessory of the invention.

Drawing FIGS. 1 through 4 illustrate a golf accessory 10 which may be utilized as both a divot tool and a money clip. The golf accessory 10 is fabricated from a piece of stamped metal which is formed with a flat, planar disc shaped metal shield 12 which may include as its center 14 the emblem of a golf tournament, golf country club, or golf association. The metal shield 12 has both an obverse surface 16 and a reverse surface 18 and is formed with a narrow, peripheral edge 20 thereabout, visible in FIGS. 2, 4 and 5.

The stamped metal member of which the golf accessory 10 is formed has a pair of thin legs 22 and 24 which extend generally parallel to each other from a location on the edge 20 of the metal shield 12. The stamped metal member also is formed with an upward projection in the form of a return or loop 26 shaped as a saddle that is curved concave upwardly from the shield 12. The return 26 extends rearwardly in a loop from the plane of the metal shield 12 at a location on the peripheral edge 20 of the shield 12 opposite the legs 22 and 24. The return 26 terminates in a generally circular backing plate 28 that is located directly behind the shield 12. Like the shield 12, the backing plate 28 has an obverse surface 30 and a reverse 32. The shield 12 and the backing plate 28 form a pair of spaced, confining members.

Figure 2:
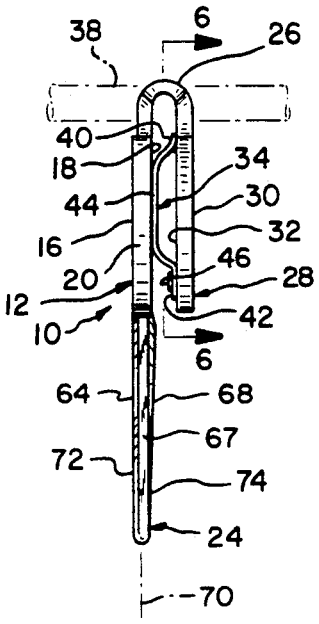
FIG. 2 is a right side elevational view thereof.
Figure 3:
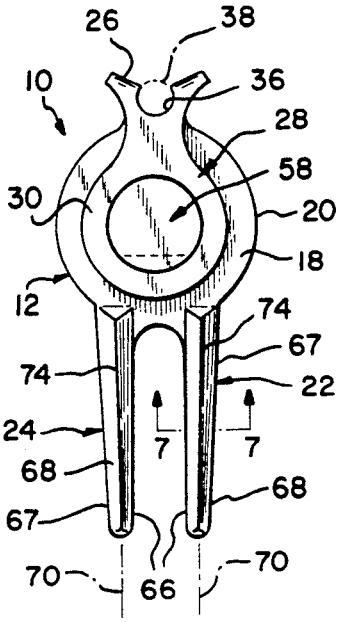
FIG. 3 is a rear elevational view thereof.
Figure 4:
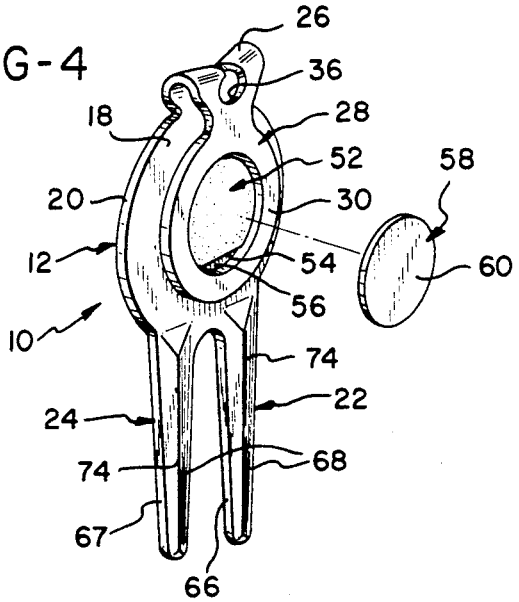
FIG. 4 is a perspective view thereof.

According to the improvement of the invention, and as illustrated in FIGS. 1, 3 and 4, a transverse, arcuate groove 36, about six millimeters in width, is defined in the return 26. The groove 36 is oriented perpendicular to the planes of both the shield 12 and the backing plate 28 and is defined in the saddle formed by the return 26 so as to cradle a cigarette 38 inserted therein such a cigarette is illustrated in phantom in drawings FIGS. 1 through 3.

In the golf accessory 10 an arcuate leaf spring 34 formed of a strip of spring steel is located between and attached to one of the confining members 12 or 28. In this embodiment the leaf spring 34 is attached to the backing plate 28. The leaf spring 34 is quite resilient and deflects to exert a pressure on articles, such as currency notes, inserted between the backing plate 28 and the shield 12.

Figure 5:
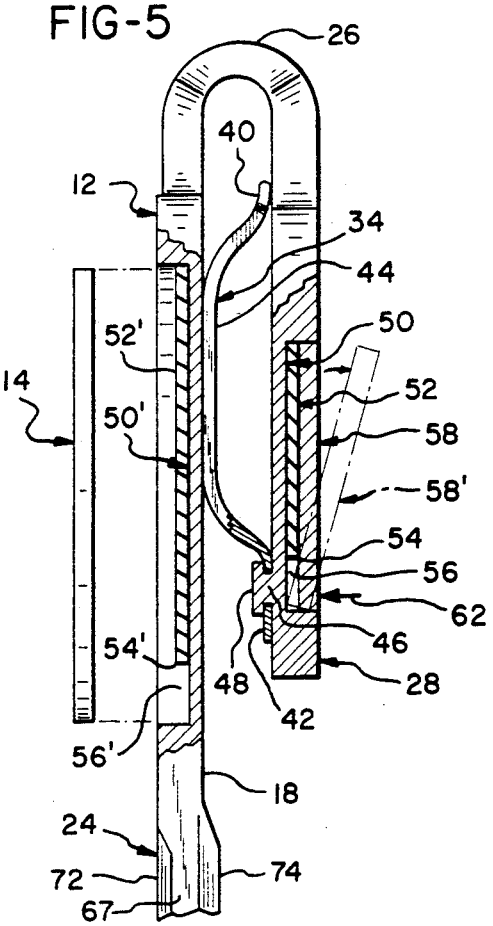
FIG. 5 is an elevational detail thereof, partially broken away.
Figure 6:
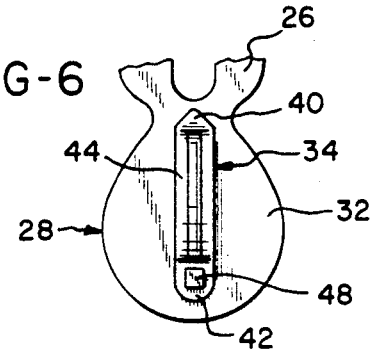
FIG. 6 is a sectional elevational view taken along the lines 6—6 of FIG. 2.
Figure 8:
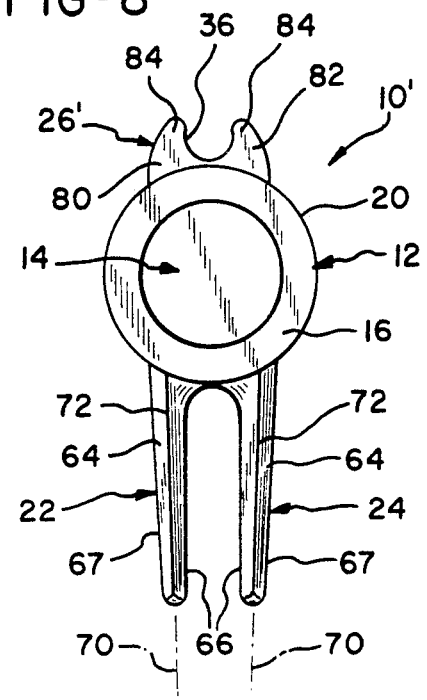
FIG. 8 is a front elevational view of another preferred embodiment of the golf accessory of the invention.

As best illustrated in FIGS. 2, 5 and 6, the leaf spring 34 has a free end 40, an opposite anchored end 42, and an arcuate intermediate portion 44 therebetween. The anchored end 42 is secured to the backing plate 28 on its reverse surface 32 by means of a rivet 46 having a shank with a square cross section. The head 48 of the rivet 46 is flattened by an upset process so as to hold the anchored end 42 of the leaf spring 34 flush against the reverse face 32 of the backing plate 28.

The anchored end 42 of the leaf spring 34 is formed with a square fastening aperture therethrough that is adapted to receive the square shank of the rivet 46 that is secured to the backing plate 28. The shank of the rivet 46 fits snugly within the square opening in the anchored end 42, and the rivet head 48 permanently clamps the anchored end 42 flat against the reverse surface 32 of the backing plate 28.

Because both the opening in the anchored end 42 of the leaf spring 34 and the shank of the rivet 46 are of corresponding, square cross section, the leaf spring 34 is restrained from rotation relative to the backing plate 28. The leaf spring 34 will therefore be permanently held in general longitudinal alignment parallel to the legs 22 and 24 of the golf accessory 10.

The arcuate portion 44 of the leaf spring 34 projects transversely toward the reverse surface 18 of the shield 12 and resides in contact therewith, as illustrated in its normal position in FIGS. 2 and 4. However, when currency bills, cardstock, or other articles are forced up into the space between the backing plate 28 and the shield 12, the arcuate portion 44 of the leaf spring 34 will resiliently deflect away from the reverse surface 18 of the shield 12 and toward the reverse surface 32 of the backing plate 28, so as to admit the material being inserted. This deflection is possible since the free end 40 of the leaf spring 34 is able to slide upwardly along the reverse surface 32 of the backing plate 28 toward the loop of the return 26. The stack of bills or other materials inserted is thereby removably clamped between the arcuate portion 44 of the leaf spring 34 and the reverse surface 18 of the shield 12 by the resilient spring action of the leaf spring 34.

While the slot 36 in the return 26 can have virtually any configuration, it is preferably formed as a generally oval shaped opening stamped out of the piece of metal stock that forms the shield 12, legs 22 and 24, return 26 and backing plate 28 before that stamped metal piece is bent beyond its elastic limit to form the return 26 and backing plate 28. That piece is originally flat and is originally about 11.7 centimeters in length. The width of the groove 36 is important, since it must be sufficiently narrow to snugly receive and frictionally grip the cylindrical structure of a cigarette 38, yet not so narrow as to excessively pinch or crush a cigarette 38 inserted therewithin. Preferably, the groove 36 is about six millimeters in width.

To employ the golf accessory 10 as a cigarette holder, the legs 22 and 24 are inserted into the fairway turf or green of a golf course so that the golf accessory 10 stands upright in the disposition depicted in FIGS. 1–4. A cigarette 38 can then be inserted into the groove 36 with the structure of the return 26 defining the groove 36 lightly gripping the cylindrical surface of the cigarette 38 somewhere along its length. A golfer is thus freed to execute a golf stroke without being forced to extinguish the cigarette 38, and without being forced to hold it in his or her mouth while executing the golf shot. Once the shot has been completed the golfer merely lifts the cigarette 38 from the slot 36 and retrieves the golf accessory 10.

As illustrated in FIGS. 3—5, the backing plate 28 is formed with a recessed area or depression 50 defined therein. The recessed area 50 may, for example, be about two and a half millimeters in depth and about eighteen millimeters in diameter. A magnetic slab 52 is provided and is formed from a sheet of rubber in which magnetic iron or iron oxide particles are embedded. The magnetic slab 52 is shaped in the form of a circular disc with a segment removed beneath its straight lower edge 54, which extends as a chord near the lower extremity of the disc shaped recess 50. The magnetic slab 52 thereby occupies less than the entire peripheral area of the recessed region 50, thus leaving an unfilled cavity indicated at 56 at the lower periphery of the recessed area 50.

The magnetic slab 52 is preferably only about one millimeter in thickness and is secured by some adhesive to the floor of the recessed area 50 in the backing pate 28. There is therefore sufficient area atop the magnetic slab 52 in the recessed area 50 to receive a flat, disc shaped ball marker 58.

The ball marker 58 is formed of a material attracted by magnetism, such as a thin wafer of iron or steel. The ball marker 58 has the same diameter as the magnetic slab 52, so that it may be removably located atop the magnetic slab 52 and completely cover the slab 52 as illustrated in FIGS. 3 and 5. The magnetic ball marker 58 is thereby removably disposed in the recessed region 50 and is held there by the magnetic force of the flat magnetic slab 52.

The exposed surface 60 of the ball marker 58 is typically decorated with some ornamental design or logo. As is evident from FIG. 5, the greater portion of the steel ball marker 58 resides directly atop and in contact with the magnetic slab 52. The force of magnetic attraction exerted by the magnetic slab 52 is thereby sufficient to hold the ball marker 58 in juxtaposition thereagainst within the recessed region 50 unless it is intentionally removed. It should be noted, however, that the lower extremity of the ball marker 58 extends below and beyond the lower edge 54 of the magnetic slab 52 and out over the cavity 56.

When external force is exerted against the lowermost edge of the ball marker 58, as indicated by the directional arrow 62 in FIG. 5, the ball marker 58 will tilt like a lever, with the edge 54 of the magnetic slab 52 serving as a fulcrum. This external force 62 against the lowermost edge of the ball marker 58 pushes the lower edge of the ball marker 58 into the cavity 56. This rotates the much larger remaining portion of the ball marker 58 about the lower edge 54 of the magnetic slab 52, out of the recessed region 50 and out of contact with the magnetic slab 52, as illustrated in phantom at 58' in FIG. 5.

When the ball marker resides in the position indicated at 58', the strength of the magnetic field attracting the upper portion of the ball marker 58 is relatively weak. Also, the upper edge of the ball marker 58 is fully exposed and no longer resides in the recessed region 50. This edge of the ball marker 58 opposite the edge at which the force 62 is applied is thereby tilted out of the recessed area 50, and can be easily gripped between the golfer's thumb an forefinger and removed for deployment on the golf surface to mark the position of a golf ball. Once it has served this purpose, it may be returned to its position in the recessed region 50, where it is again held by the magnetic attraction of the magnetic slab 52. The golfer is thus provided with a convenient means for storing a ball marker.

Oftentimes it is convenient for a golfer to have a choice of ball markers. This may arise merely out of a personal preference for a marker of a different size, or to avoid confusion with other ball markers which may be present on the green at the same time. In either event, the golf accessory 10 does provide the golfer with an alternative choice of ball markers. Specifically, and as illustrated inn FIG. 5, another recess region 50' is provided in the obverse face 16 of the body or shield 12. The recessed region 50' may be considerably larger than the recessed region 59 and typically is about 2.54 centimeters in diameter. Another magnetic slab 52', similar to but larger than the magnetic slab 52, is likewise formed as a circular disc with a segment removed at its lower edge 54'. The magnetic slab 52' is likewise formed of rubber having particles of magnetized iron or steel embedded therein. The magnetic slab 52' fits snugly within the recessed opening 50' and is secured by adhesive therein.

The center 14 of the shield 12 is formed as a second ball marker and is fabricated from a thin, disc shaped wafer of steel. Like the ball marker 58, the exposed face of the ball marker 14 is decorated in an aesthetically pleasing manner with the logo of a golf tournament or country club, or the emblem of some golf association. Alternatively, and like the ball marker 58, the ball marker 14 may be decorated with a more personalized design and may bear the name of the golfer to which the golf accessory 10 belongs.

The second ball marker 14 is seated and held in the recessed 50' in the shield 12 in the same manner that the ball marker 58 is held in the recess 50 in the backing plate 28. As illustrated in FIG. 5, the second ball marker 14 is aligned with the recess 50' in the shield 12 and moved into juxtaposition atop the magnetic slab 52'. Since the ball marker 14 is formed of a material which is attracted by the force of magnetism, it will remain in the recess 50' until intentionally removed. The second ball marker 14 may be removed from the recess 50' in the same manner that the ball marker 58 is removed from the recess 50 in the backing plate 28. That is, once ball marker 14 has been inserted into the recess 50', the golfer need merely press its lower edge into the cavity 56' left below the lower edge 54' of the magnetic slab 52'. The ball marker 14 can thereby be tilted out of the recess 50' in the same manner as previously described in association with the ball marker 58.

The configuration of the legs 22 and 24 of the golf accessory 10 is somewhat different from that depicted in my prior patent. The legs 22 and 24 both have obverse surfaces 64 and reverse surfaces 68. Also, the legs 22 and 24 have mutually proximate longitudinally extending edges 66 and mutually remote longitudinally extending edges 67. The proximate edge 66 and the remote edge 67 of each leg reside on opposite sides of a longitudinal axis of each leg, indicated at 70.

Figure 7:
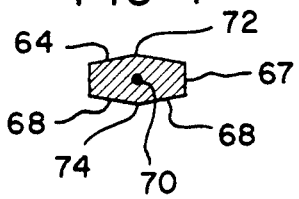
FIG. 7 is a sectional elevational detail taken along the lines 7—7 of FIG. 3.

Each of the legs 22 and 24 has a raised rib 72 on its obverse surface 64 and another raised rib 74 on its reverse surface 68, both in lateral alignment with the longitudinal axis 70. In this way, each of the legs 22 and 24 is laterally tapered in cross section and has a greatest thickness between the longitudinal ribs 72 and 74 along its longitudinal axis 70, as best illustrated in FIG. 7. The thickness of each leg 22 and 24 tapers laterally toward both the proximate edge 66 and the remote edge 67 on both the obverse surface 64 and the reverse surface 68. As illustrated in FIG. 7, the cross section of each of the legs 22 and 24 is generally in the shape of a hexagon which is wider than it is thick.

With the raised ribs 72 and 74 and tapered cross section on both the obverse sides 64 and reverse sides 68 of the structures of the legs 22 and 24, the legs can be inserted into the turf of a golf course, particularly of a golf green, and removed more easily therefrom as contrasted with prior divot tools. The golf accessory 10 thereby leaves less of a trace of its use in repairing a green, or for any other purpose for which the legs 22 and 24 are inserted into the golf course turf.

As with my prior golf accessory described in my prior U.S. Pat. No. 4,627,621, the golf accessory 10 can be used as a tool for divot repair and as a combination divot repair tool and money clip. Also, as with the device of my prior patent the legs 22 and 24 of the divot tool 10 can be inserted into the turf of the golf course and the grip of a golf club can be propped up on the saddle shaped return 26 to keep the golf club handle out of the grass. Unlike my prior golf accessory, however, the golf accessory 10 of the present invention provides a means for supporting a cigarette 38 above the level of the golf course turf, thus preserving it while a golfer executes a golf shot. Also, the resilient nature of the leaf spring 34 allow paper bills and other articles of a much greater variation in thickness to be inserted between the mutually facing reverse surfaces 18 and 32 of the shield 12 and backing plate 20, respectively. A golfer is therefore far less limited as to the thickness of materials which can be inserted into the golf accessory 10 and accommodated between the shield 12 and backing plate 28.

Furthermore, the golf accessory 10, unlike my prior golf accessory, provides means for magnetically holding ball markers 58 and 14 in readily removable fashion, and a means for conveniently manipulating the ball markers 58 and 14 out of their stored positions in the concave recessed regions 50 and 50' in the obverse sides of the backing plate 28 and body 12, respectively. Furthermore, the projecting ribs 72 and 74 on both the obverse sides 64 and reverse sides 68 of the legs 22 and 24 allow the legs of the golf accessory of my invention to penetrate the soil of a golf course fairway or green in a more sword-like fashion, thus minimizing the adherence of soil thereto when the golf accessory is withdrawn therefrom.

FIGS. 8–11 illustrate an alternative embodiment of a golf accessory according to the present invention. This golf accessory is indicated generally at 10' in those drawing figures. The golf accessory 10', like the golf accessory 10, has a flat, planar body or shield 12 having an obverse surface 16 and a reverse surface 18 with a peripheral edge 20 therebetween. Also, the golf accessory 10' has a pair of generally parallel legs 22 and 24 which are of the same construction as described with respect to the golf accessory 10, with particular reference to FIG. 7.

Figure 9:
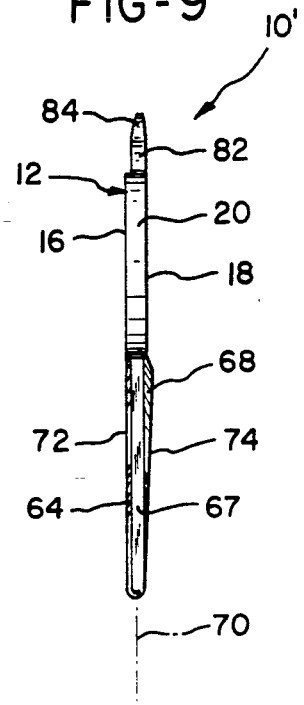
FIG. 9 is a right side elevational view thereof.
Figure 10:
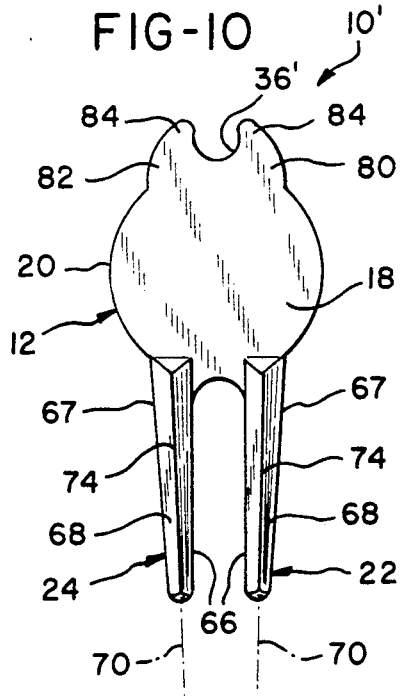
FIG. 10 is a rear elevational view thereof.

The golf accessory 10' differs from the golf accessory 10 in that it does not include a return. Rather, it has a projection 26' on the body or shield 12 opposite the legs 22 and 24 that lies entirely within the plant of the shield 12. The projection 26' is bifurcated by a groove or slot 36' to form a pair of ears 80 and 82. The ears 80 and 82 straddle and define the groove 36'. As best illustrated in FIG. 9, the ears 80 and 82 taper in a transverse direction at their extremities remote from the legs 22 and 24. The tips 84 of the ears 80 and 82 are tapered to a narrow width so that they fit into the grooves in the face of a golf club. The tips 84 of the ears 80 and 82 can thereby be inserted together into a groove in a golf club face and the golf accessory 10' can be moved parallel to the groove in the golf club face so that the tips 84 will plow out any dirt or soil in the groove as they travel therealong. The several grooves in a golf club face can thereby be cleaned sequentially in this manner using the golf accessory 10'.

Figure 11:
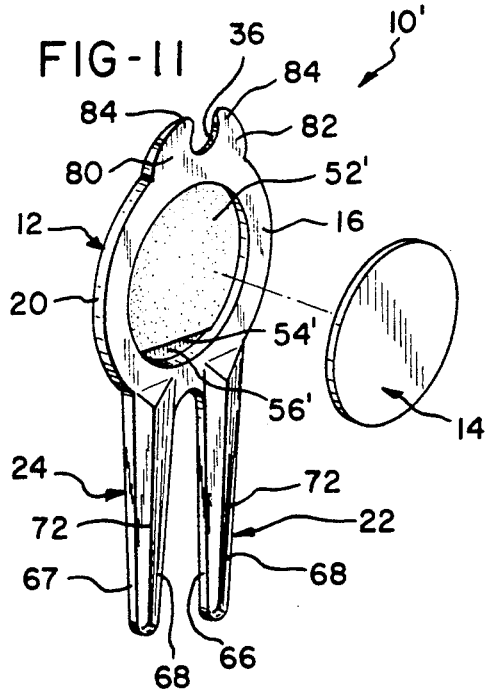
FIG. 11 is a perspective view thereof.

As illustrated in FIG. 11, the golf accessory 10' is also provided with a removable ball marker 14 which fits into a recess 50' in the shield 12. The ball marker 14 is held in the recess 50' by means of a magnetic slab 52'. The ball marker 14 may be inserted into, removed from, and otherwise manipulated in the manner previously described with respect to the golf accessory 10.

Undoubtedly, numerous variations and modifications of the present invention will become readily apparent to those familiar with golf accessories. Accordingly, the scope of the invention should not be construed as limited to the specific embodiments depicted and described herein, but rather is defined in the claims appended hereto.

I claim:

1. A golf accessory formed with a flat, planar body having an obverse surface and a reverse surface and a peripheral edge therebetween, a pair of elongated generally parallel legs extending from said peripheral edge, and a projection from said peripheral edge at a location on said body opposite said legs formed as a return bent in a loop and terminating in a planar backing plate located in spaced separation from said reverse surface of said body and parallel thereto, said planar body and said backing plate forming a pair of spaced members, a leaf spring secured to one of said spaced members to project toward the other of said spaced members, whereby said leaf spring is resiliently deformable to flex and exert pressure on articles inserted between said leaf spring and said other of said spaced members, and wherein each of said spaced members has an exposed surface which defines entirely within its confines a recessed region, and further comprising a flat, magnetic slab secured within each said recessed region, and a flat ball marker formed of a material attracted by magnetism removably disposed in each said recessed region and held there by the magnetic force of said flat, magnetic slab.

2. A golf accessory according to claim 1 wherein said magnetic slabs in said recessed regions occupy less than the entire peripheral areas of their respective recessed regions thus leaving unfilled cavities at the peripheral areas of both of said recessed regions beneath portions of said ball markers, whereby external forces against edges of said ball markers disposed over said cavities overcomes the magnetic attraction of said magnetic slabs and tilts opposite edges of said ball markers out of said recessed areas.

3. In a golf accessory formed with a flat, planar metal shield having a peripheral edge thereabout, a pair of thin legs extending generally parallel to each other from said edge of said metal shield, and a projection from said metal shield at a location on said peripheral edge opposite said legs, wherein said projection is formed as a return passing upwardly from said shield opposite said legs and extending rearwardly from said plane of said metal shield and terminating in a backing plate located behind said shield in a plane parallel thereto, said shield and said backing plate together defining a pair of spaced members, the improvement comprising a leafspring secured to one of said spaced members and projecting toward the other of said spaced members, wherein said leafspring has a free end and an opposite anchored end having an opening of polygonal cross section formed therein, and said anchored end is secured to said backing plate by a fastener having a shank with a polygonal cross section that fits snugly within said opening in said anchored end, whereby said leaf spring is compressible to receive and exert pressure on articles inserted between said leaf spring and said other of said spaced members and said leafspring is restrained from rotation relative to said backing plate, and wherein at least one of said spaced members has an exposed surface with a recess defined entirely within the confines of said exposed surface, and further comprising a magnet located in said recess and covering less than the entire peripheral area thereof, and a ball marker formed of a material attracted by magnetic force and removably positionable atop said magnet in said recess, whereby said magnet holds said ball marker in said recess with magnetic force.

4. In a combination money clip and golf accessory formed with a flat, planar metal shield having a peripheral edge thereabout, a pair of thin legs extending generally parallel to each other from said edge of said metal shield, a return extending upwardly from said shield and rearwardly from said plane of said metal shield at a location on said peripheral edge of said shield opposite said legs and terminating in a backing plate located behind said shield, whereby said shield and said backing plate form a pair of spaced members, the improvement comprising a leaf spring located between and attached to one of said spaced members so as to resiliently deflect to exert a pressure on articles inserted between said backing plate and said shield, and wherein said backing plate has an exposed surface and a backing plate recess defined entirely within and completely surrounded by said exposed surface, a backing plate magnet located in said backing plate recess and covering less than the entire peripheral area thereof, a first ball marker formed of a material attracted by magnetism removably located atop said backing plate magnet in said backing plate recess, and wherein said shield has an obverse surface with a shield recess defined therewithin having an area greater than the area of said backing plate recess, and further comprising a shield magnet located in said shield recess and covering less than the entire peripheral area thereof, and a second ball marker having an area larger than that of said first ball marker and formed of a material attracted by magnetic force and removably positionable atop said shield magnet in said shield recess, whereby said shield magnet holds said second ball marker in said shield recess with magnetic force.

* * * * *